United States Patent [19]

Wilson

[11] 4,442,950

[45] Apr. 17, 1984

[54] OPENING AND CLOSING MEANS FOR A CONTAINER TOP

[76] Inventor: Thomas P. Wilson, 4063 Deervale Dr., Sherman Oaks, Calif. 91403

[21] Appl. No.: 460,394

[22] Filed: Jan. 24, 1983

[51] Int. Cl.[3] ..... B65D 41/32

[52] U.S. Cl. ..... 220/269; 220/336

[58] Field of Search ..... 220/268, 1, 273, 336

[56] References Cited

U.S. PATENT DOCUMENTS 4,008,823 2/1977 Tarro ..... 220/269

4,207,991 6/1980 Amabili ..... 220/269

*Primary Examiner*—George T. Hall

*Attorney, Agent, or Firm*—Howard N. Sommers

[57] ABSTRACT

A top for initially closing a container, so as to seal same and preserve the contents thereof. The top includes a tab, selectively operable for forming an opening in the top, or for reclosing and resealing, or reopening, such opening. Such selective operation of the tab enables access to the contents of the container, or preservation of or access to the remaining contents of the container, as desired by the user.

12 Claims, 10 Drawing Figures

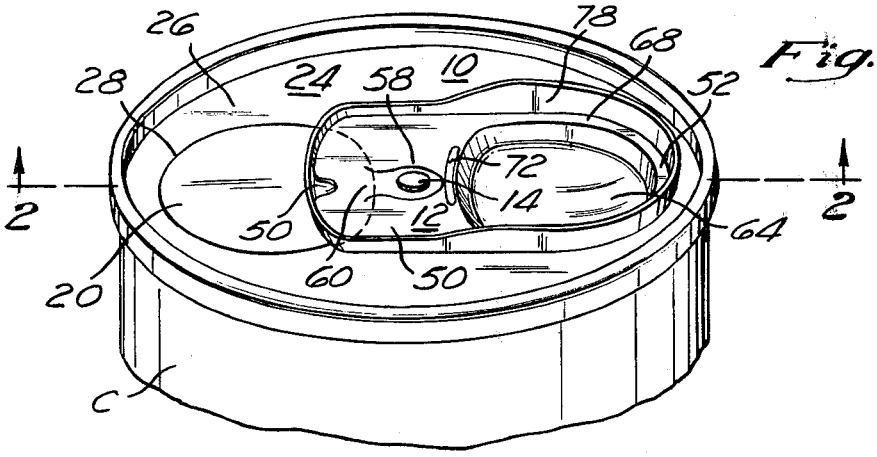
Fig. 1
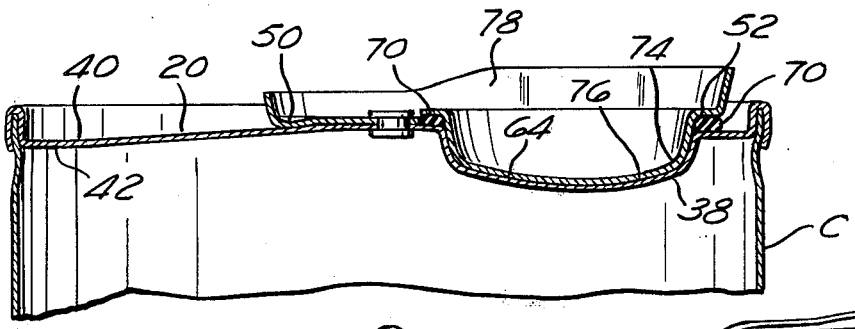
Fig. 2
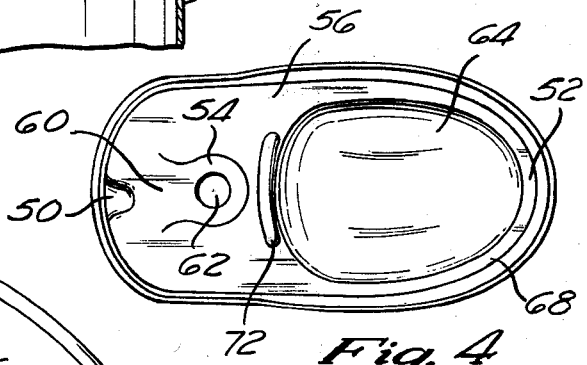
Fig. 4
Fig. 3
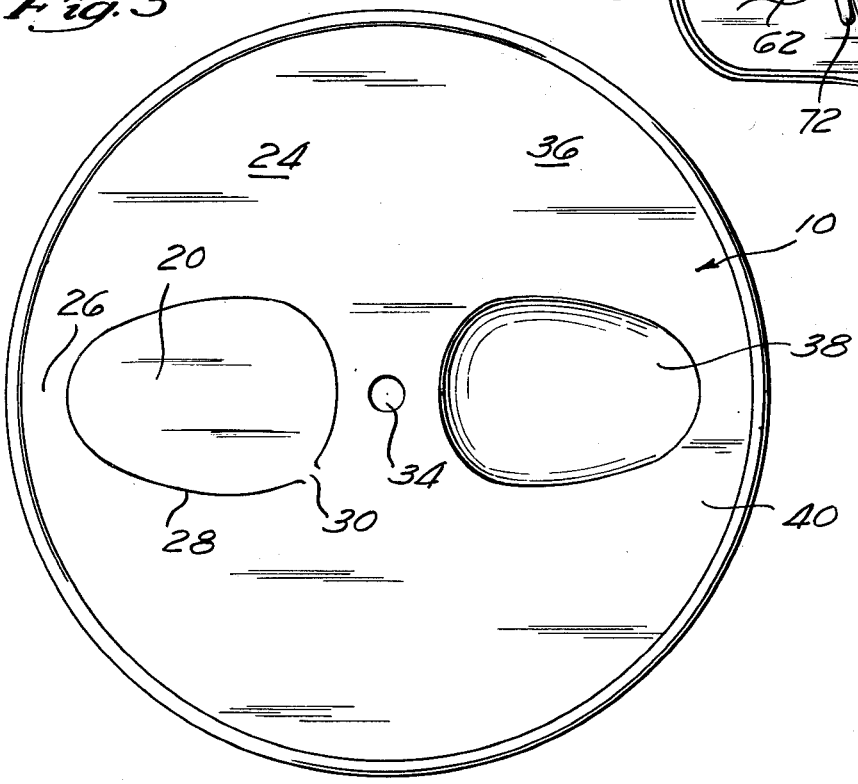

Fig. 8
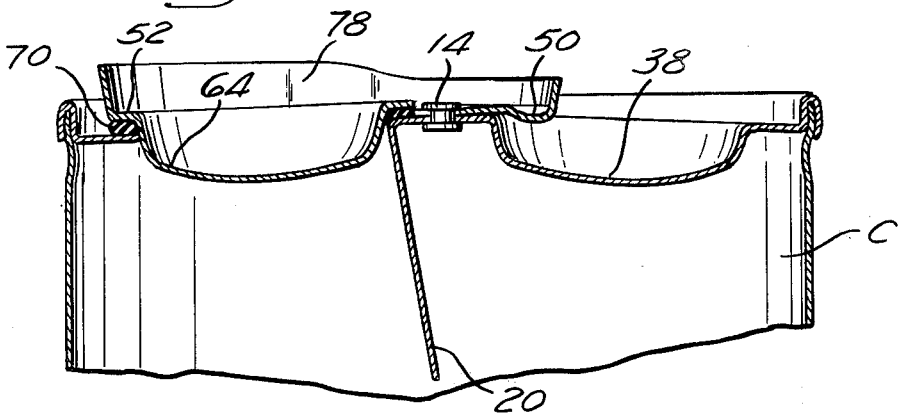
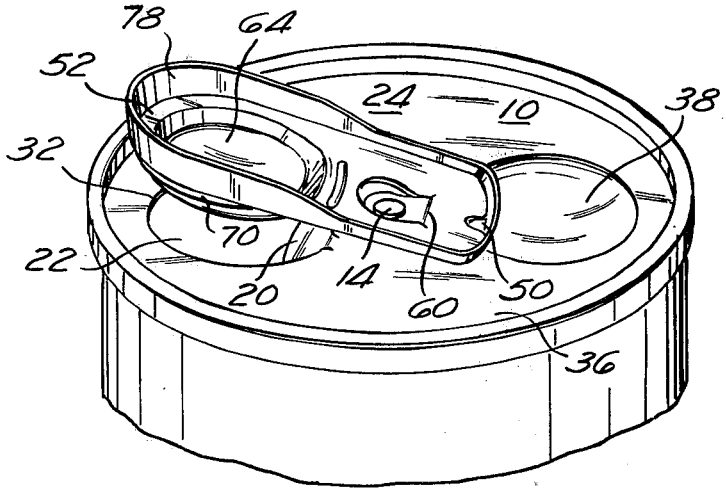
Fig. 9
Fig. 10
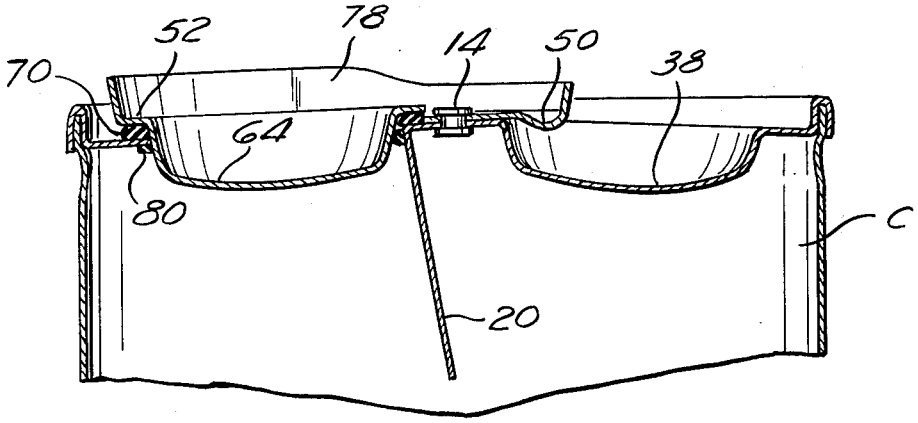

OPENING AND CLOSING MEANS FOR A CONTAINER TOP

BACKGROUND OF THE INVENTION

The invention relates generally to a top for a container. It relates specifically to a container top adapted to initially close and seal the container. A portion of the container top is adapted to be selectively operable to open, reclose and reseal, or reopen the container as desired by the user.

The prior art includes tops for containers, which tops initially seal such containers. In certain prior art, such container tops include portions thereof selectively operable to open the container. In other prior art, such container tops include portions thereof selectively operable to open, reclose, and reopen the container.

Container tops in the prior art which initially seal the containers, and which include portions selectively operable to open the containers, include, for example, those known as "flip-top" containers. Such containers include tabs which are revolvable and pivotable for opening the containers.

Container tops in the prior art which initially seal the containers, and which include portions selectively operable to open, reclose, and reopen the containers include, for example, those set forth in U.S. Pat. Nos. 3,952,911, 3,259,265 and 4,077,538. Such patents disclose container tops which include pivotable and revolvable operating portions. Further, U.S. Pat. Nos. 3,424,338, 4,232,797, 4,164,303 and 4,156,016 disclose reclosable caps for containers, which caps include pivotable portions.

However, the prior art "flip top" containers are not operable for reclosing and resealing, or reopening the container, as desired by the user, thereby limiting the utility, effectiveness, and convenience thereof. Further, the prior art mechanisms disclosed in the above patents are complex, difficult to operate, and ineffective, inconvenient, and inefficient to use, particularly those which include portions adapted to enable reclosing and resealing of the container, for preserving the remaining contents of an opened container.

SUMMARY OF THE INVENTION

The invention is adapted to overcome the above problems and others associated with the prior art. It provides a top for a container, which includes a tab including first and second opposed end portions. The tab second end portion includes a shaped sub-portion and a sealing ring therein. The container top further includes a body member, on which the tab is mounted, which body member includes a partly detachable portion in one side thereof, and a shaped portion in the other side thereof.

The user may selectively operate the tab of the container top as desired. The first end portion of the tab is selectively operable to engage and partly-detach the partly-detachable portion of the one side of the body member. Such selective operation forms an opening in the body member, through which the user may have access to and consume the desired quantity of the contents of the container. As to the remaining contents of the container, the user may selectively operate the second end portion of the tab, for resealing or reopening the container. The shaped sub-portion of the tab second end portion is initially reained in the shaped portion in the other side of the body member. The shaped sub-portion and ring of the tab are selectively movable into or out of closing and sealing relationship relative to the opening formed in the body member. Such selective movement enables the user to either preserve or consume the remaining contents of the container, as desired, to effectively reseal the contents of the container. It is particularly useful in containers which contain carbonated beverages, for preserving the carbonation thereof.

The container top of the invention is adapted to initially close the container so as to seal same. It is further adapted to be selectively operable, as desired by the user, for the purposes of forming an opening, reclosing and resealing, and reopening the container. Such adaptation for selective operation enables access to the contents for consumption of as much as desired thereof. It further enables preservation of, and access to, the remaining contents of the container. Such adaptation provides a container top selectively operable in an effective, efficient, and convenient manner.

DESCRIPTION OF THE DRAWINGS

FIG. 1 is a perspective partly-fragmentary view of the container top of the invention, with the tab thereof in the non-operated position;

FIG. 2 is a side cross-sectional partly-fragmentary view of the container top with the tab in the non-operated position thereof;

FIG. 3 is a top plan view of the body member of the container top;

FIG. 4 is a top plan view of the tab of the container top;

FIG. 8 is a side cross-sectional partly-fragmentary view of the container top, with the tab in the opening-sealing position thereof; and FIG. 9 is a perspective partly-fragmentary view of the container top, with the tab in the partly-reopening position thereof.

FIG. 10 is a side cross-sectional partly-fragmentary view of the container top in a further embodiment thereof, with the tab in the opening-sealing position.

DETAILED DESCRIPTION OF THE INVENTION

The invention, as shown in the figures and as described herein, comprises a top for a container C. The container top is adapted to initially seal container C. It includes a portion thereof adapted to enable selective opening, reclosing and resealing, and reopening of container C, as desired by the user.

Container C may comprise, for example, a can for containing a carbonated beverage such as soda or beer. The container top and container C may both be comprised, for example, of aluminum.

The container top, as shown in FIGS. 1 and 2, includes a body member 10, adapted to be mounted on the top portion of container C. It further includes a tab 12, adapted to be mounted on body member 10, and to be selectively rotatable on, and pivotable into or out of engagement with, body member 10. A pin 14 is adapted to mount tab 12 on body member 10.

Figure 5:
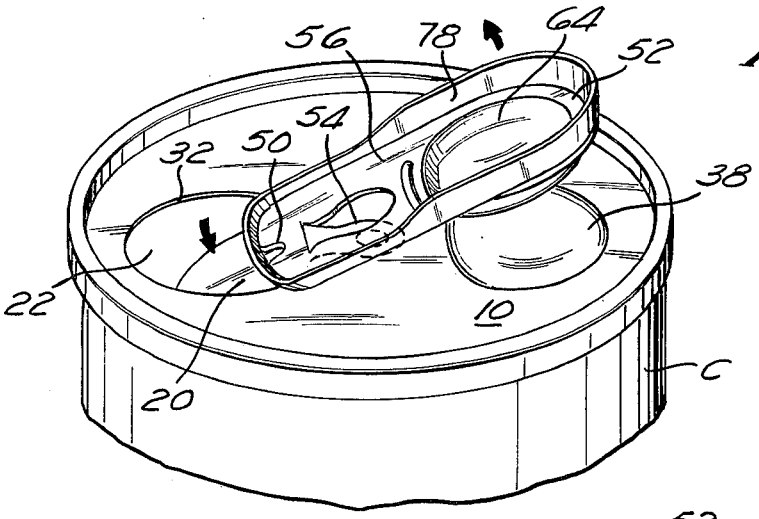
FIG. 5 is a perspective partly-fragmentary view of the container top, with the opening partly formed therein.

Body member 10, as shown in FIGS. 1–3, is generally disk-shaped. It includes a partly-detachable sub-portion 20, adapted to initially close and seal body member 10. Sub-portion 20 is further adapted to be partly-detached so as to form an opening 22 in body member 10, as shown in FIG. 5.

Sub-portion 20 is formed in a first side portion 24 of body member 10. It is partly detachable from a surrounding sub-portion 26, defined by the part of first side portion 24 surrounding sub-portion 20. Sub-portion 20 is partly-detachable from sub-portion 26 along a score line 28 formed in first side portion 24 of body member 10. An attaching portion 30 attaches sub-portion 20 to sub-portion 26, after partial detachment of sub-portion 20 along score line 28. An opening-defining edge 32 is formed along score line 28 in body member 10.

Body member 10 further includes a medial opening 34, adapted to receive pin 14 therethrough, and a second side portion 36, including a shaped sub-portion 38 therein, adapted to initially retain part of tab 12. A first surface 40 of body member 10 faces outwardly from the interior of container C upon mounting body member 10 on container C. A second surface 42 of body member 10 faces inwardly towards the interior of container C upon mounting body member 10 on container C. The shape of the outwardly-facing surface 40 of shaped sub-portion 38 of body member 10 is generally outwardly concave.

Tab 12, as shown in FIGS. 1, 2 and 4, includes first and second opposed end sections 50 and 52. First end section 50 is adapted to be engagable with the sub-portion 20 of body member 10, for forming opening 22. Second end section 52 is adapted to be initially retained in shaped sub-portion 38 of body member 10. It is further adapted to be rotatable and pivotable into or out of closing and sealing relationship with respect to opening 22 formed in body member 10, for reclosing and resealing, or reopening thereof.

First end section 50 includes a partly-detachable sub-section 54, adapted to be partly-detached from a surrounding section 56. Sub-section 54 is further adapted to enable rotation of tab 12 about pin 14, and pivoting of tab 12 thereabout into or out of engagement with body member 10. It is defined by the part of first end section 50 surrounding sub-section 54. Sub-section 54 is partly-detachable from sub-section 56 along a score line 58 formed in first end section 50 of tab 12. An attaching section 60 attaches sub-section 54 to sub-section 56, after partial detachment of sub-section 54 from sub-section 56 along score line 58. Sub-section 54 includes an opening 62, adapted to receive pin 14 therethrough.

Second end section 52 includes a shaped sub-section 64 therein, generally complementary in shape to, and adapted to be initially retained in, shaped sub-portion 38 of body member 10. Sub-section 64 is further adapted to reclose opening 22 in body member 10. An abutting sub-section 66 of shaped sub-section 64 is adapted to abut against opening-defining edge 32 of body member 10 upon reclosing of opening 22. A peripheral shoulder 68 extends about the perimeter of sub-section 64. A ring 70 is secured to shoulder 68 of sub-section 64. It is adapted to be initially retained in shaped sub-portion 38 of body member 10, and to reseal opening 22 in body member 10. Ring 70 is comprised, for example, of a resilient material such as rubber or a rubber-like composition. A protruding rib 72 extends partly around and proximate to shaped sub-section 64. a first surface 74 of tab 12 faces outwardly away from first surface 40 of body member 10, upon mounting tab 12 on body member 10. A second surface 76 of tab 12 faces inwardly toward first surface 40 of body member 10, upon mounting tab 12 on body member 10. The shape of the outwardly-facing surface 72 of shaped sub-section 64 is generally complementary to the shape of the outwardly-facing surface 40 of shaped sub-portion 38 of body member 10, and is generally outwardly concave. A peripheral upstanding rim 78 extends about tab 12. In a further embodiment, as shown in FIG. 10, tab 12 further includes a second ring 80, secured to shaped sub-section 64 and spaced from ring 70. Second ring 80 is comprised, for example, of a resilient material such as rubber or a rubber-like composition.

Pin 14, as shown in FIGS. 1–4, extends through opening 62 in shaped sub-section 64 of tab 12, and medial opening 34 in body member 10.

In use, the initial container-sealing configuration of body member 10, and non-operated position of tab 12, is shown in FIGS. 1 and 2. In such configuration of body member 10, partly-detachable sub-portion 20 is attached to surrounding sub-portion 26 along score line 28 and at attaching portion 30. Further, in such non-operated position of tab 12, shaped sub-section 64 is positioned in shaped sub-portion 38 of body member 10. In such configuration and position, sub-portion 20 of body member 10 seals container C and the contents thereof.

To open the initially-sealed container C, for enabling access to and consumption of as much of the contents of container C as the user desires, by forming opening 22, second end section 52 of tab 12 is pivoted upwardly, as shown in FIG. 5. The user may grip rim 78 of tab 12 for enabling efficient pivoting movement. Such movement of tab 12 causes partial detachment of sub-section 54 thereof, along score line 28, enabling rotation thereof about pin 14, generally in a plane parallel to the plane of body member 10, and further causes pivoting of first end section 50 thereof on surrounding section 56 of tab 12, into engagement with sub-portion 20 of body member 10. Continued upward pivoting of second end section 52 of tab 12 exerts pressure, through downwardly-pivoting first end section 50, against and causes detachment, except at attaching portion 30, of sub-portion 20, forming opening 22, and opening-defining edge 32 of body member 10.

Figure 6:
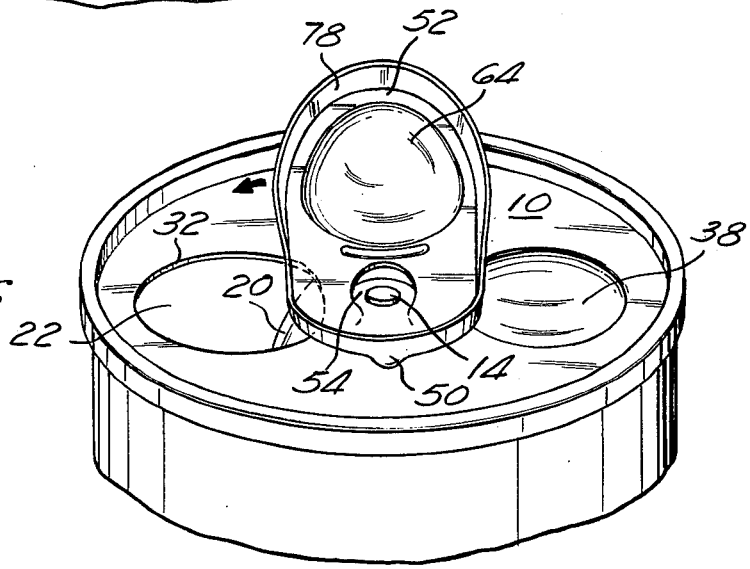
FIG. 6 is a similar view, with the tab partly rotated away from the opening.
Figure 7:
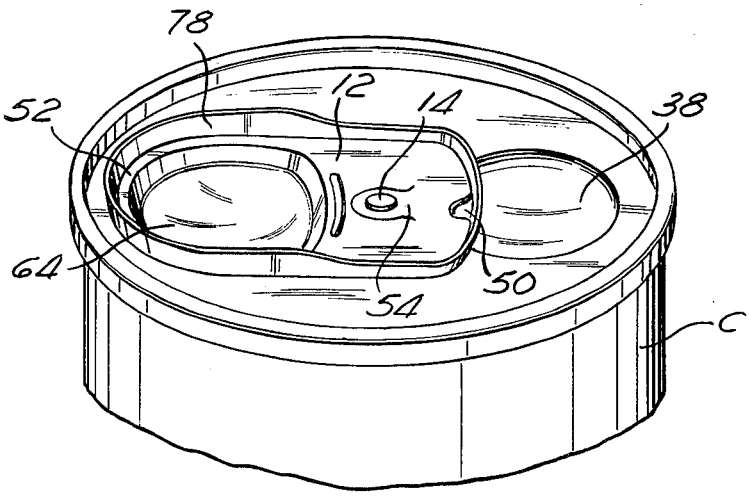
FIG. 7 is a similar view, with the tab in the opening-sealing position thereof.

To reclose and reseal opened container C, for preserving the remaining contents of container C, tab 12 is rotated as shown in FIG. 6, on partially-detached sub-section 54, until second end section 52 is generally aligned with opening 22. Second end section 52 of tab 12 is then pivoted downwardly, on surrounding section 56 of tab 12, so as to press sub-section 64 into opening 22, as shown in FIGS. 7 and 8. In such position, abutting sub-section 66 of tab 12 abuts opening-defining edge 32 of body member 10. A seal is effected thereby, between abutting sub-section 66 of tab 12 and opening-defining edge 32 of body member 10, and between ring 70 of tab 12 and surrounding sub-portion 26 of body member 10. This seal is particularly useful for preserving the carbonation of carbonated beverages such as beer or soda contained in container C. The user can thereby preserve the remaining contents of the container, for consumption at a later time. The seal may be effected by the abutting sub-section 66 of the tab 12 having an outside diameter the same as or slightly less than the diameter of opening 22 in body member 10, so as to form an interference fit when pressed into opening 22.

To reopen the reclosed and resealed container C, for enabling access to and consumption of the remaining contents thereof, second end section 52 of tab 12 is disengaged from opening 22, as shown in FIG. 9. This may be effected by either pivoting upwardly second end section 52 of tab 12, or pivoting downwardly first end section 50 of tab 12, on surrounding section 56 of tab 12. The user may grip rim 78 of tab 12 for pivoting movement. Tab 12 is then rotated, on partially-detached sub-section 54, away from the reclosing and resealing position in FIG. 7, towards the initial position in FIG. 1, exposing opening 22.

In the further embodiment shown in FIG. 10, resealing is further effected by pressing second ring 80 through opening 22, whereupon second ring 80 resiliently returns to its original shape. A further seal is effected thereby, between second ring 80 of tab 12 and surrounding sub-portion 26 of body member 10, on inwardly-facing second surface 42 of body member 10. Reopening is further effected by pivoting tab 12, disengaging tab 12 from opening 22.

A preferred embodiment of the invention has been set forth above, for the purpose of explaining the invention. However, it is to be understood that variations may be made in such embodiment, which variations are nevertheless within the scope and spirit of the invention, as set forth in the claims herein.

I claim:

1. A top for initially closing and sealing a container, adapted to enable selective opening, reclosing, and reopening of the container, as desired by the user, comprising:

(a) a body member, adapted to be mounted on the container, and to initially close and seal the conainer, including means for enabling an opening to be formed therein;

(b) a tab, adapted to be mounted on the body member, including means for enabling the tab to be selectively operable for engaging or disengaging the body member, means for selectively engaging the opening-forming means in the body member so as to enable the opening to be formed, for selectively opening the container, and means for selectively engaging or disengaging the opening formed in the body member, for selectively reclosing or reopening the container; and (c) means for mounting the tab on the body member, to enable selective operation of the tab relative to the body member.

2. A top as in claim 1, in which the tab includes first and second opposed end sections, the first end section includes therein the means for selectively engaging the opening-forming means, and the second end section includes therein the means for selectively engaging or disengaging the opening.

3. A top as in claim 1, in which the means for selectively engaging or disengaging the opening are further adapted to reseal the opening upon engagement therewith.

4. A top as in claim 1, in which the body member further includes a shaped portion, and the means in the tab for selectively engaging or disengaging the opening include a shaped section, generally complementary in shape to the shape of the body member shaped portion, adapted to interfit in the body member shaped portion or body member opening.

5. A top as in claim 1, further comprising means for enabling the tab to be gripped for movement thereof.

6. A top as in claim 1, in which the body member further includes a surface which faces inwardly upon mounting the body member on the container, and the tab further includes means for resealing the opening, adapted to be positionable in sealing relation to the inwardly-facing surface of the body member.

7. A top as in claim 3, in which the means for selectively engaging or disengaging the opening include a ring, secured to the tab, comprised of flexible material, and adapted to be positioned in sealing relation to the body member.

8. A top as in claim 4, in which the body member includes a surface which faces outwardly upon mounting the body member on the container, and the tab includes a surface which faces outwardly upon mounting the tab on the body member, and in which the shapes of the outwardly-facing surfaces of the body member shaped portion and the tab shaped portion are outwardly concave.

9. A top as in claim 4, in which the means for selectively engaging or disengaging the opening are further adapted to reseal the opening upon engagement therewith, the body member includes an edge defining the opening, and the tab further includes a peripheral shoulder, extending about the perimeter of the shaped section, and a ring, secured to the peripheral shoulder of the tab, comprised of flexible material, adapted to be positioned in sealing relation to the body member, and in which the shaped section of the tab includes a subsection adapted to abut and seal the opening-defining edge of the body member.

10. A top as in claim 4, in which the body member further includes a surface which faces inwardly upon mounting the body member on the container, and the tab further includes means for resealing the opening, adapted to be positionable in sealing relation to the inwardly-facing surface of the body member, comprising a ring, secured to the shaped section of the tab, comprised of flexible material.

11. A top as in claim 5, in which the tab includes first and second opposed end sections, the first end section includes therein the means for selectively engaging the opening-forming means, and the second end section includes therein the means for selectively engaging or disengaging the opening, and the means for enabling the tab to be gripped for movement thereof comprise a peripheral upwardly-projecting rim extending along the sides of the second end section of the tab.

12. A top as in claim 7, in which the ring is comprised of rubber or rubber-like material.

* * * * *

Notice of Adverse Decision in Interference

In Interference No. 101,479, involving Patent No. 4,442,950, T. P. Wilson, OPENING AND CLOSING MEANS FOR A CONTAINER TOP, final judgment adverse to the patentee was rendered Aug. 18, 1986, as to claims 1-12.

[*Official Gazette December 2, 1986.*]